United States Patent [19]

De Marchi et al.

[11] Patent Number: 4,905,384

[45] Date of Patent: Mar. 6, 1990

[54] SKI BOOT

[75] Inventors: Jean-Louis De Marchi, Duingt; Fabrice Legon, Seynod, both of France

[73] Assignee: Salomon S. A., Annecy Cedex, France

[21] Appl. No.: 242,770

[22] Filed: Sep. 12, 1988

[30] Foreign Application Priority Data

Sep. 11, 1987 [FR] France ..... 87 12790

[51] Int. Cl.[4] ..... A43B 5/04; A43C 11/00

[52] U.S. Cl. ..... 36/117; 36/50

[58] Field of Search ..... 36/117–121, 36/50, 1; 24/117, 119

[56] References Cited

U.S. PATENT DOCUMENTS

| | | | |
|---|---|---|---|
| 657,606 | 9/1900 | Lee | 24/119 |
| 990,991 | 5/1911 | Kuehner | 36/1 |
| 4,142,307 | 3/1979 | Martin | 36/50 |
| 4,759,137 | 7/1988 | Lederer | 36/117 |
| 4,823,484 | 4/1989 | Couty | 36/117 |

FOREIGN PATENT DOCUMENTS

| | | | |
|---|---|---|---|
| 3740147 | 6/1988 | Fed. Rep. of Germany | 36/117 |
| 2450575 | 10/1980 | France | 36/117 |

*Primary Examiner*—James Kee Chi

*Attorney, Agent, or Firm*—Pollock, Vande Sande & Priddy

[57] ABSTRACT

A rear-entry ski boot whose rear piece (3) is provided with a flexibly connected guide device (15) constituting a tightening and closing system (8) which is always well positioned for gripping by the skier.

11 Claims, 4 Drawing Sheets

SKI BOOT

FIELD OF THE INVENTION

The present invention relates to downhill ski boots whose upper comprises front and rear pieces which close against the lower portion of the leg of the skier through the intermediary of closing and tightening means.

BACKGROUND OF THE INVENTION

Ski boots of this type usually comprise a rear piece articulated either on the shell base or on a rearward extension of the front piece, and a tightening assembly which assures the movement of the rear piece toward the front piece, and thus the closure of the upper on the lower portion of the leg of the skier. Conventionally, the tightening system consists of a flexible connection which, anchored on one of the lateral wings of the front piece, surrounds the rear portion of the rear piece and is tensioned by a bracing lever connected to the other lateral wing of the front piece. Examples of such devices are disclosed in French Patent No. 2,345,959 and U. S. Patent No. 4,083,127.

The bracing levers of these tightening assemblies engage a rack by their transverse pivoting axis, which engages in a notch of said rack, or which are mounted for pivoting movement on a hinge and are therefore themselves provided with a rack into which the flexible connection, such as the loop of a cable, is hooked. When the upper is opened, the bracing lever is pivoted in the direction of freeing up the cable, which disengages from its hooked position on the forward piece through the intermediary of the lever. Regardless of the kind of connection of the cable with the lever, the cable constituting the loop is then retained on the boot only by the anchoring means located on the wing opposite the one for hooking the bracing lever. As a result, the cable and/or the bracing lever is free to float in all directions, and is often in random positions which are frequently not adapted to the next closure attempt. Moreover, the cable is subject to being damaged during ill-timed and undesirable hooking, since it is then relatively projecting with respect to the boot.

In other boots known in the prior art, the upper is constituted by a single part subjected to a tightening assembly whose flexible connection, such as lacing, is maintained on the rear part of the upper through the intermediary of guide means constituted by guide slots and keepers provided thereon. Examples can be found in Swiss Patent No. 370,335 and French Patent No. 624,336. These boots do not present the problem of boots having an articulated rear part, but teach flexibly connected guide means fixed in position on the upper. These means always retain the flexible connection in good position for tightening the upper, but have certain drawbacks. In French Patent No. 624,336, the means are irremovable, so that the flexible connection cannot be easily replaced in case of wear, and in Swiss Patent No. 370,335, the guide means are relatively in relief with respect to the wall of the upper and are hence subject to rapid deterioration.

SUMMARY OF THE INVENTION

The guide device according to the present invention is intended to eliminate these drawbacks, and applies in particular to ski boots whose upper is provided with front and rear pieces which are drawn together by a flexible connection tightening system so as to close the upper against the lower part of the skier's leg.

According to the invention, the object of the device is to maintain the flexible connection, on the one hand, close to the means for coupling the bracing lever on the front piece when the rear piece is brought against the front piece, and, on the other hand, on the rear piece whatever may be the position of the latter, and in particular when the rear piece is uncoupled from the front piece. Another object of the invention is to integrate the flexible connection and its guide means within the rear piece without uneven surfaces and while assuring sliding of the connection and its eventual replacement due to its interchangeability.

To this end, the device is constituted by a recess in the rear piece, extending transversely of the upper and corresponding to the direction of the passage of the flexible connection of the tightening means in its active tightening position, and by a replaceable cover adapted to the recess, the cover being provided with hooking means cooperating with the wall of the rear piece. These hooking means may be constituted, for example, by at least one lug which passes through the wall of the rear piece in order to lodge therein through the intermediary of retaining means. On the outer side of the upper, this cover has a profile adjusted to that of the rear piece of which it constitutes a part and assures the continuity, and on the side corresponding to the passage of the connecting means, at least one clearance which extends opposite the recess in the rear piece.

BRIEF DESCRIPTION OF THE DRAWINGS

In order that the invention may be more clearly understood, it will now be described with reference to the accompanying drawings, wherein several embodiments of the invention are shown for purposes of illustration, and wherein.

DESCRIPTION OF PREFERRED EMBODIMENTS

Figure 1:
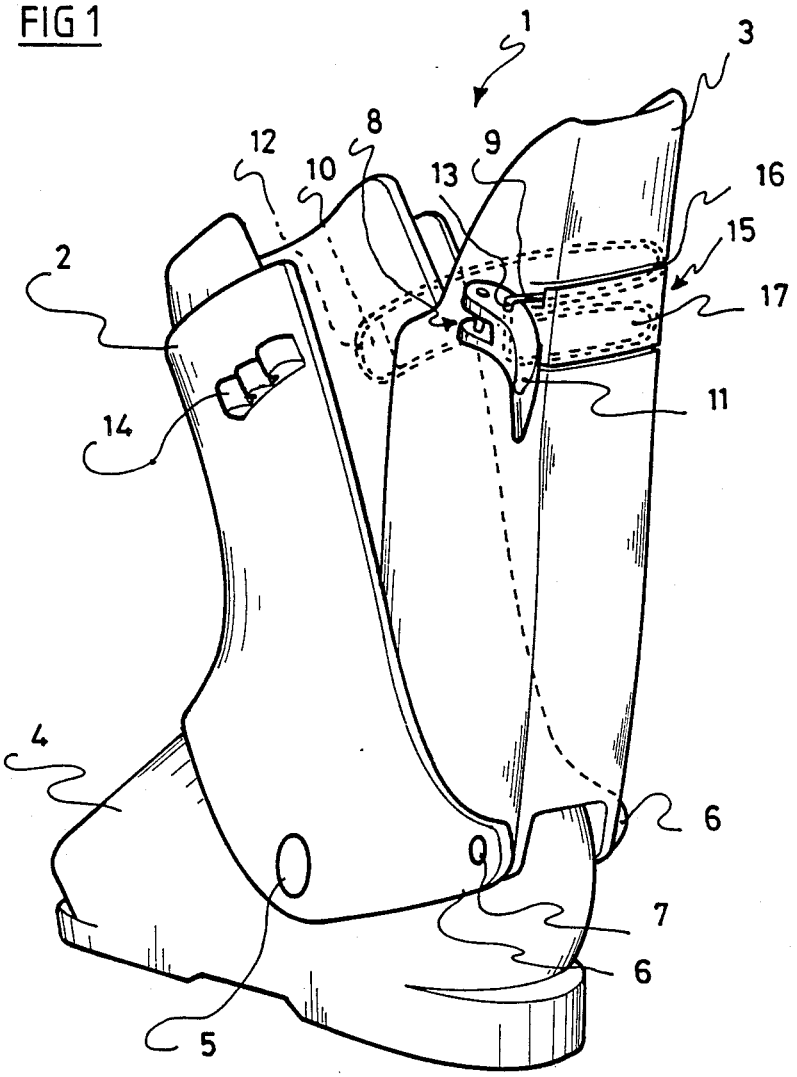
FIG. 1 is a perspective view of a ski boot provided with the guide device according to the invention.
Figure 3:
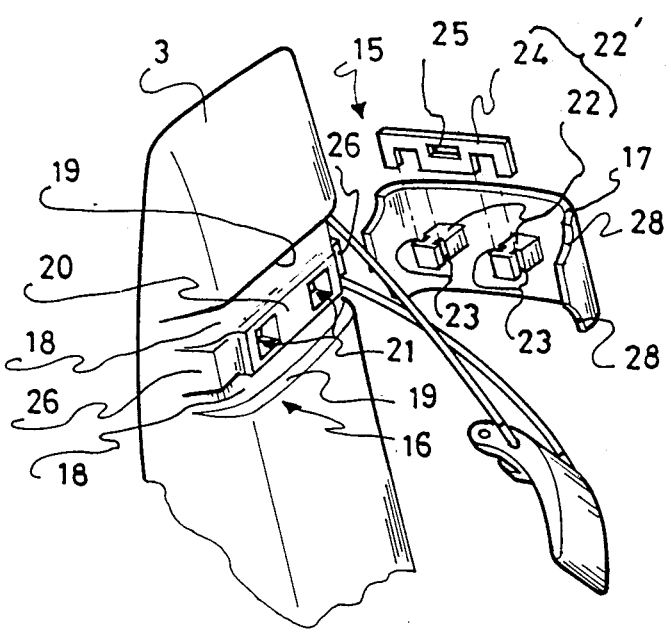
FIGS. 2 and 3 show in perspective constructional details of the ski boot.

According to the invention, the ski boot shown in FIG. 1 has an upper 1 constituted by a front piece 2 and a rear piece 3, and a shell base 4 to which the upper is attached by rivets 5. In this type of construction,the rear piece 3 is articulated on lower lateral extensions 5 of the front piece about a transverse axis 7. The assembly 8 for tightening and closing the upper against the lower part of the skier's leg comprises, in a manner known per se, a bracing lever 11 which tensions a flexible connection such as a cable loop attached by its ends 12 and 13 to the front piece 2 while its intermediate portion passes around the rear piece 3. End 12 of the loop is mounted on an anchoring stud 10 of the front piece, while its end 13 is connected to the bracing lever 11 which cooperates with the notches of a rack 14 fixed on the front piece.

Figure 2:
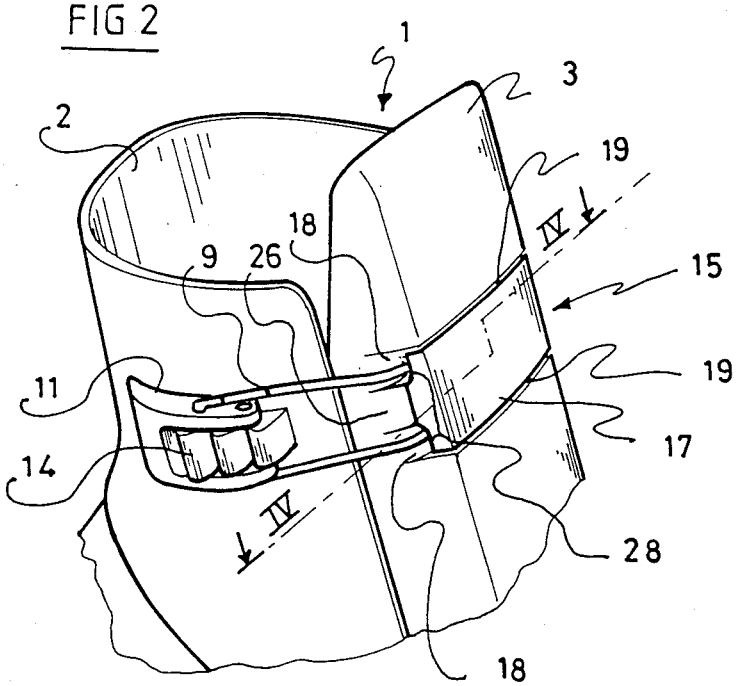
Figure 4:
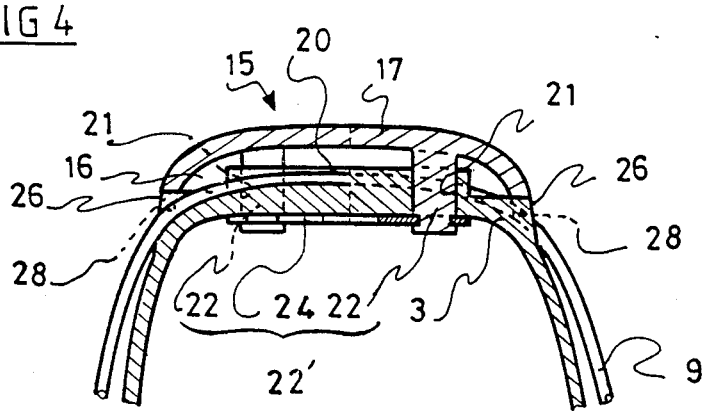
FIG. 4 is a section view along line IV—IV of FIG. 2.

According to the invention, a device 15 for guiding the cable 9 is associated and integral with the rear piece 3 in the region through which the cable passes in its active position, as shown in FIG. 2. In this position, the cable is tensioned by lever 11 which is in engagement with rack 14, while its intermediate portion, which passes around rear piece 3, causes the latter to pivot and to be retained against front piece 2. The guide device shown in FIGS. 1 to 4 comprises a recess 16 in rear piece 3 and a removable cover 17 adapted to the recess in a complementary manner. Recess 16 extends transversely to the axis of the upper and has two guide grooves 18, each delimited i their transverse direction by the wall of rear piece 3 which constitutes shoulders 19, and by a central land 20, each of the so delimited grooves 18 providing a passage for a strand of cable 9. Two openings 21 are provided in the central land 20, traversing the wall of rear piece 3 and cooperating with hooking means 22' of cover 17 on the latter. The cover is provided with two notches 28 complementary to guide grooves 18, and with two lugs 22 constituting part of hooking means 22' and whose dimensions and spacing correspond to openings 21. The respective end of lugs 22 extends inside rear piece 3 and comprises vertical grooves 23 for receiving a notched plate 24, whereby lugs 22 are retained in position on rear piece 3. Notched plate 24 is retractable due to a control slot 25. Moreover, lateral bosses 26 on rear piece 3 constitute abutments for cover 17 on the latter.

Figure 5:
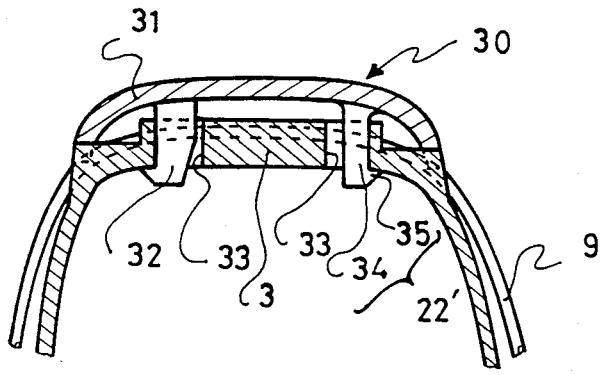
FIGS. 5 and 6 are section views, similar to FIG. 4, of second and third embodiments of the invention.
Figure 6:
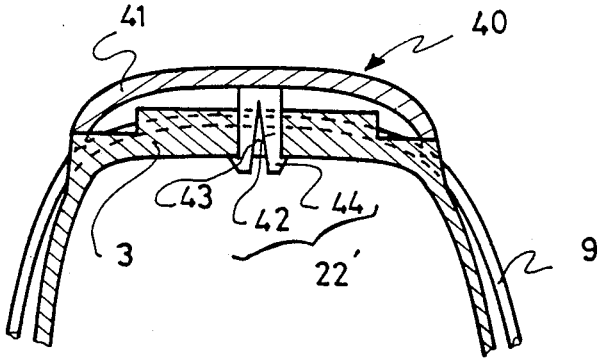

In the embodiments shown in FIGS. 5 and 6, guide devices 30 and 40 resemble device 15 of the preceding figures, with the exception of means 22' for hooking the cover on rear piece 3.

In FIG. 5, the cover 31 comprises a hooking lug 32 which is introduced into one of the openings 33 of rear piece 3 so as to be supported against the interior wall of the latter, and a resilient locking lug 34 which is passed through the other opening 33 so as to resiliently engage said interior wall by retaining means constituted by a bevelled tip 35 opposite hooking lug 32.

In FIG. 6, the cover 41 is provided with a resilient lug 42 which passes through an opening 43 in rear piece 3 and engages resiliently through the intermediary of a bevelled flange piece 44 against the wall of the rear piece.

Figure 7:
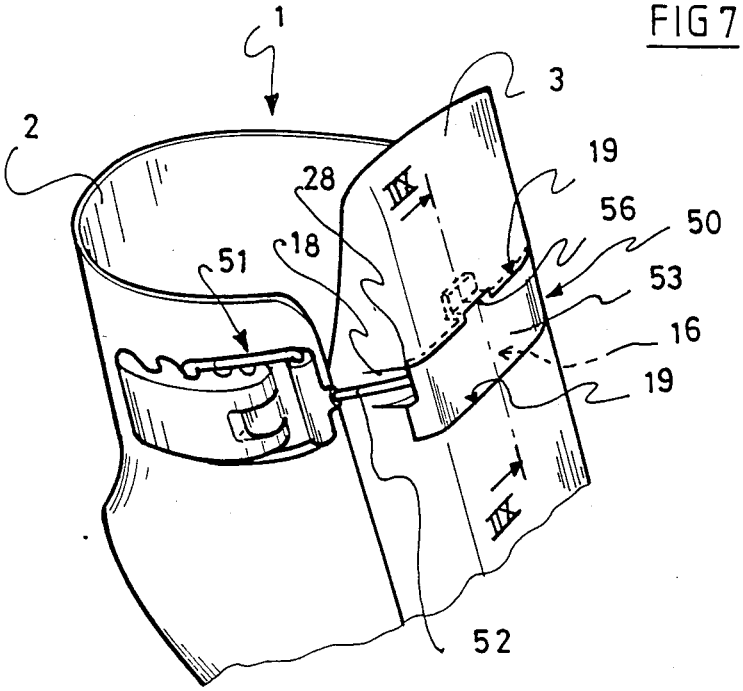
FIG. 7 is a perspective view of a fourth embodiment of the invention.
Figure 8:
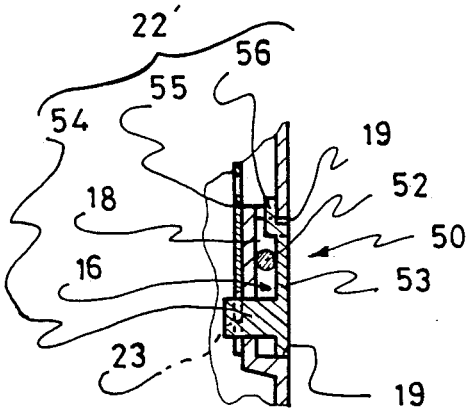
FIG. 8 is a section view along line IIX—IIX of FIG. 7.

The guide device 50 shown in FIGS. 7 and 8 differs from the above-described devices in that the tightening assembly 51 comprises a single flexible connection, such as a cable 52. The cover 53 is retained in this embodiment by a grooved lug 54 into which a notched plate 55 engages, and by a hooking tongue 56 located substantially in the central part of the cover, on the other side of the cable passage from grooved lug 54. It goes without saying that the cover of the guide device can be retained on the rear piece by any other suitable means, such as screws or glue.

The cover may have a profile which is more or less in relief from the general profile of the rear piece, and may also be made of a material, especially as regards wear and/or resistance to abrasion by the cable and its sliding movement.

What is claimed is:

1. Ski boot comprising a shell base and an upper comprising a rear piece which closes a front part, and an assembly for tightening, by flexible connection means, said rear part against said front part, said tightening assembly comprising guide device (15; 30; 40; 50) constituted by a recess (16) in said rear piece (3) of said upper (1) and extending in the direction of a passage of a said flexible connection means (9; 52), and a removable cover (17; 31; 41; 53) corresponding to said recess, said cover being provided with hooking means (22') cooperating with a wall of said rear piece, said guide device being located in an upper rear portion of said rear piece (3).

2. Ski boot according to claim 1, wherein said cover has an exterior profile adjusted to that of said rear piece and assuring continuity of said rear piece.

3. Ski boot according to claim 1, wherein said cover has an exterior profile recessed with respect to that of said rear piece.

4. Ski boot according to claim 1, wherein said cover has an exterior profile projecting from that of said rear piece.

5. Ski boot according to claim 1, wherein said recess (16) comprises at least one guide groove (18) corresponding to said passage of said flexible connection.

6. Ski boot according to claim 5, wherein said cover comprises at least one notch (28) complementary to at least one guide groove (18).

7. Ski boot according to claim 1, wherein said hooking means (22') are detachable.

8. Ski boot according to claim 1, wherein said hooking means (22') are constituted by at least one lug (22; 34; 42; 54) passing through a wall of said rear piece (3) and blocked in position by retaining means (24; 35; 44; 55; 56).

9. Ski boot according to claim 8, wherein said retaining means (24; 55) is a notched plate which fits in vertical grooves (23) on the end of at least one lug of said cover.

10. Ski boot according to claim 8, wherein said retaining means (35; 44) is constituted by a bevelled end of at least one resiliently locking lug (34; 42).

11. Ski boot according to claim 8, wherein said retaining means (56) is a hooking tongue associated with at least one lug (54).

* * * * *